US006732460B2

(12) United States Patent
Blakeslee

(10) Patent No.: US 6,732,460 B2
(45) Date of Patent: May 11, 2004

(54) ILLUMINATED DISPLAY ASSEMBLY

(76) Inventor: Bill Blakeslee, 161 Felismere Rd., #108, Sebastian, FL (US) 32958

( * ) Notice: Subject to any disclaimer, the term of this patent is extended or adjusted under 35 U.S.C. 154(b) by 0 days.

(21) Appl. No.: 09/995,111

(22) Filed: Nov. 27, 2001

(65) Prior Publication Data

US 2002/0105813 A1 Aug. 8, 2002

Related U.S. Application Data

(60) Provisional application No. 60/253,559, filed on Nov. 28, 2000.

(51) Int. Cl.[7] ..... G09F 13/04; G09F 7/12

(52) U.S. Cl. ..... 40/564; 40/575; 40/597

(58) Field of Search ..... 40/564, 575, 576, 40/591, 593, 597, 716, 606.12; 362/812

(56) References Cited

U.S. PATENT DOCUMENTS

| | | | | | |
|---|---|---|---|---|---|
| 1,229,483 | A | | 6/1917 | Libby | |
| 1,274,899 | A | | 8/1918 | Kretz | |
| 1,457,206 | A | | 5/1923 | Benjamin | |
| 1,520,257 | A | | 12/1924 | Morlan et al. | |
| 1,535,823 | A | | 4/1925 | Goodwin | |
| 1,894,857 | A | * | 1/1933 | Dwyer et al. | 40/579 |
| 2,336,016 | A | * | 12/1943 | Jayne et al. | 40/564 |
| 2,562,740 | A | | 7/1951 | Rizer | |
| 2,618,089 | A | | 11/1952 | Rose | |
| 2,622,356 | A | * | 12/1952 | Valente | 40/575 |
| 3,038,271 | A | | 6/1962 | MacHutchin et al. | |
| 3,188,761 | A | | 6/1965 | Harrold | |
| 3,703,779 | A | * | 11/1972 | Goldman | 40/615 |
| 4,424,449 | A | | 1/1984 | O'Brill | |
| 4,475,298 | A | | 10/1984 | Munoz | |
| 4,744,012 | A | | 5/1988 | Bergkvist | |
| 4,903,423 | A | | 2/1990 | Hinca | |
| 4,951,406 | A | * | 8/1990 | Lemire | 40/576 |
| 4,970,816 | A | * | 11/1990 | Trame | 40/552 |
| 5,073,842 | A | | 12/1991 | Moñroe | |
| 5,150,960 | A | | 9/1992 | Redick | |
| 5,177,889 | A | | 1/1993 | Ching Hwei | |
| 5,255,166 | A | | 10/1993 | Gonzalez | |
| 5,339,550 | A | | 8/1994 | Hoffman | |
| 5,373,428 | A | | 12/1994 | Day | |
| 5,444,931 | A | | 8/1995 | Hillstrom | |
| 5,584,547 | A | * | 12/1996 | Trulaske | 312/223.5 |
| 5,666,749 | A | | 9/1997 | Waters | |
| 5,680,709 | A | * | 10/1997 | Stone | 33/613 |
| 5,803,560 | A | * | 9/1998 | Trulaske, Sr. et al. | 312/223.5 |
| 6,154,994 | A | * | 12/2000 | O'Brien et al. | 40/575 |
| 6,258,200 | B1 | * | 7/2001 | Kassab | 156/273.1 |

* cited by examiner

*Primary Examiner*—Brian K. Green
(74) *Attorney, Agent, or Firm*—Robert L. Wolter, Esquire; Beusse Brownlee Wolter; Mora & Maire, P.A.

(57) ABSTRACT

An illuminated display assembly includes a flexible, translucent and rectangular display plate having an outer edge including two opposing side edges and two opposing end edges, and an image depicted on the display plate within the outer edge of the plate. The display plate also has a width dimension measured from the opposing side edges. The display plate is mounted to a support frame having a rectangular panel and a support member extending along a periphery of the panel. The support member includes two opposing side supports and two opposing end supports. A retainer is disposed along each of the side supports and the support frame has a dimension measured from the retainer on the side support that is less than the width of the display plate. Thus, when the retainer receives respective side edges of the display plate, the display plate deforms in a convex shape with respect to the support frame. The support members have a convex top surface extending subjacent and concentric with respect to the end edges of the display plate. An illuminating device is fixed to the support frame between the reflective surface and the display plate.

10 Claims, 6 Drawing Sheets

ILLUMINATED DISPLAY ASSEMBLY

This application claims the benefit of provisional application No. 60/253,559, filed Nov. 28, 2000.

BACKGROUND OF THE INVENTION

This invention relates generally to illuminated displays. More specifically, this invention pertains to illuminated displays capable of being mounted on a vehicle.

Illuminated displays generally include a support frame upon which a display plate is mounted. The display plate can be constructed from a translucent material having an image depicted on the plate; or, the plate may be opaque having non-opaque images. Lighting fixtures are typically mounted on the support frame between the display plate and the support frame, and illuminate the image depicted on the plate. The support frame is mounted on a front or rear bumper of the vehicle and the light fixtures are connected to the vehicle electrical system.

Several different illuminated display assemblies are disclosed in the following patents: U.S. Pat. No. 4,475,298, issued to Munoz; U.S. Pat. No. 5,150,960, issued to Redick; U.S. Pat. No. 5,177,889, issued to Hwei; U.S. Pat. No. 5,255,166, issued to Gonzalez; U.S. Pat. No. 5,339,550; issued to Hoffman; and, U.S. Pat. No. 5,666,749, issued to Waters.

Despite the illuminated displays available, a need exists for an illuminated display that is inexpensive to manufacture, assembled with relative ease, and easy for consumers to install. In addition, a need exists for a display plate that provides a clear image when illuminated, and does not dramatically fade when exposed to artificial or natural light over time.

SUMMARY OF THE INVENTION

The present invention for an illuminated display assembly includes a translucent plate mounted to a support frame. The support frame includes a panel having a support member extending along a periphery of the panel. The display plate is constructed of a flexible material so that when the display plate is mounted to the support member, the display plate bulges to a convex shape. Thus the display plate is attached to the support member in spaced relation to an illumination device fixed to the panel of the support frame. A light reflective surface is fixed to the panel for the dispersion of light within the support frame and through the display plate.

In a preferred embodiment, the support frame may take the form of a rectangular display box, and the display plate is also rectangular. The support member has two opposing and parallel side supports, and two opposing and parallel end supports. A retainer extends along each of the side supports for receiving edges of the display plate. The dimension across the support frame measured between the retainers is less than the width of the display plate, so the display plate bulges to a convex shape with respect to an interior of the display box, when the edges of the display plate are inserted in the retainer. The end supports have a convex top surface that extends subjacent and concentrically with respect to the display plate.

The display plate includes a substrate having an image digitally reproduced on the substrate, which is encapsulated within a transparent plastic casing. An image is created in a digital format and reproduced on a sheet of banner material. An array consisting of columns and rows of the image is reproduced on the banner material. The substrate is cut, dividing the sheet into a plurality of separate substrates each having an image depicted thereon. The separate substrates, with the images thereon, are cut to a desired shape. Then the substrate is encapsulated between two plastic films using conventional laminating techniques. The plastic casing is trimmed to correspond to the shape of the substrate thereby forming a translucent and flexible display plate prepared for mounting on the support frame of the present invention

DETAILED DESCRIPTION OF THE DRAWINGS

Figure 1:
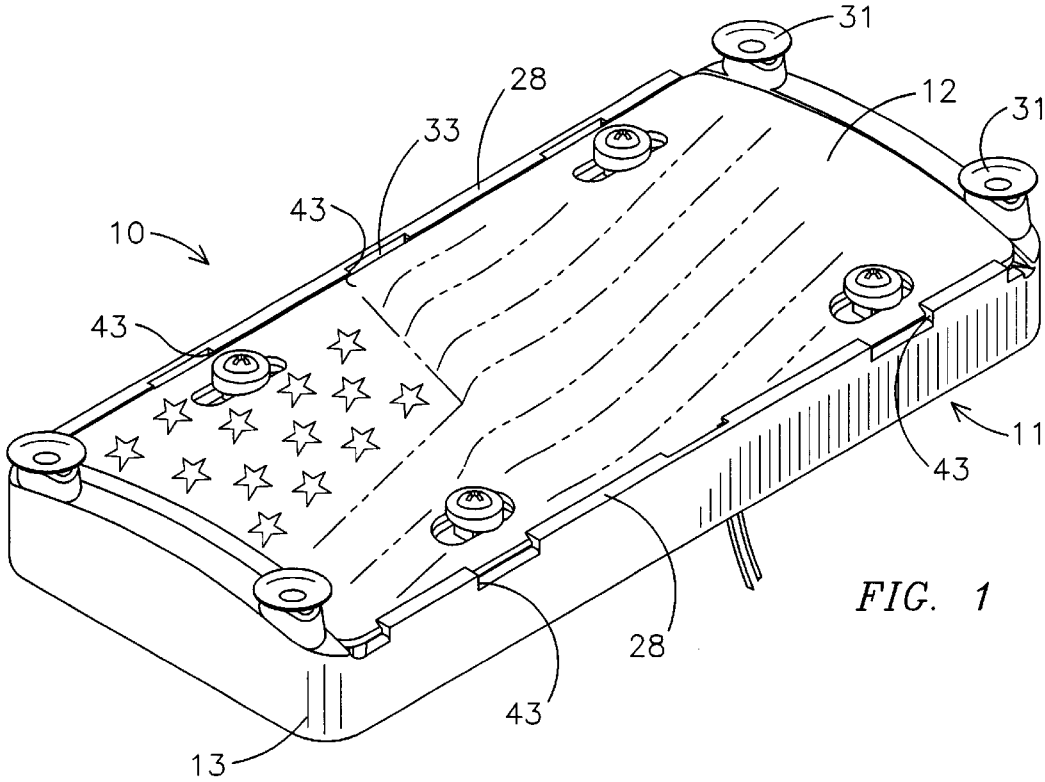
FIG. 1 is a perspective view of an illuminated display assembly.
Figure 2:
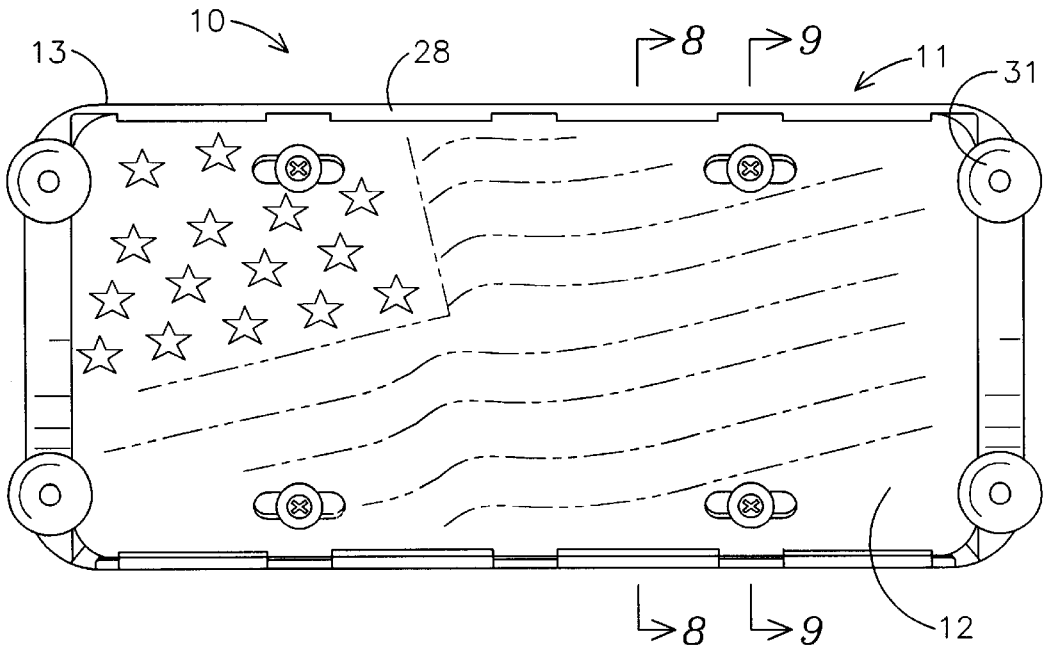
FIG. 2 is a top view of the illuminated display assembly.
Figure 3:
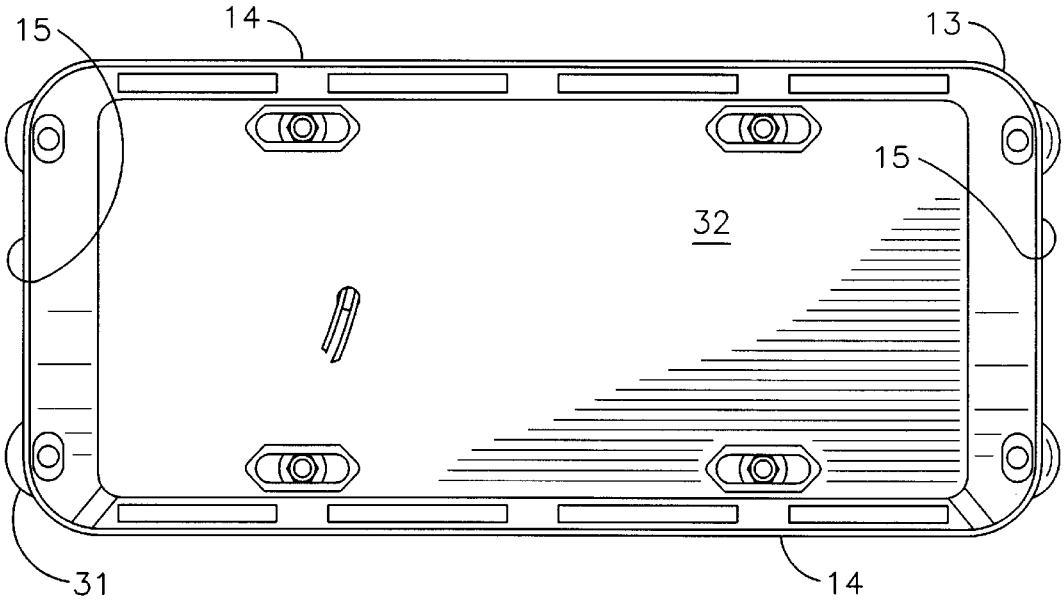
FIG. 3 is a rear elevational view of the illuminated display assembly.
Figure 4:
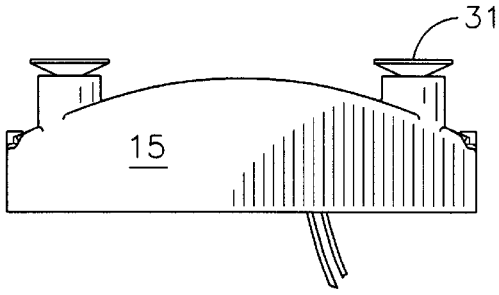
FIG. 4 is a first side elevational view of the illuminated display assembly.

The illuminated display assembly 10 is illustrated in FIG. 1 and includes a support frame 11 having a display plate 12, with an image displayed thereon, mounted on the support frame 11. The plate 12, as will be explained in more detail below, is preferably constructed of a sufficiently translucent material such as a synthetic banner material encapsulated in a transparent plastic casing by a laminating process. Thus, the plate 12 is flexible and resilient to slightly deform to fit on the support frame 11.

An illuminating device 19 (shown in FIG. 10) is mounted to the support frame 11 to provide an artificial light source. The plate 12 is mounted on the support frame 11 in spaced relation to the illumination device 19 to avoid hot spots along the plate 12 that may occur if the display plate 12 touches the illuminating device 19. The support frame 11 can be mounted on the front or rear bumper of a vehicle using conventional mounting techniques, and the illumination device 19 is connected to the vehicle electrical system, or connected to a stand alone energy source such as a battery. Alternatively, suction cups 31 can be mounted on the support frame 11 as shown in FIG. 1, so the assembly 10 can be displayed on a vehicle window. In such a case the illumination device 19 can be connected to an electrical adapter (not shown) and inserted into the outlet within a vehicle.

The support frame 11 is shown in more detail in FIGS. 2 through 8. With respect to FIG. 2, the support frame 11 has a rectangular shape, but the shape or dimensions of the support frame 11 are not intended to limit the invention. Vehicle display plates 12 are typically rectangular and a support frame 11 has a corresponding rectangular shape. The support frame 11 is preferably constructed of a durable plastic material and fabricated from an injection molding process.

Figure 6:
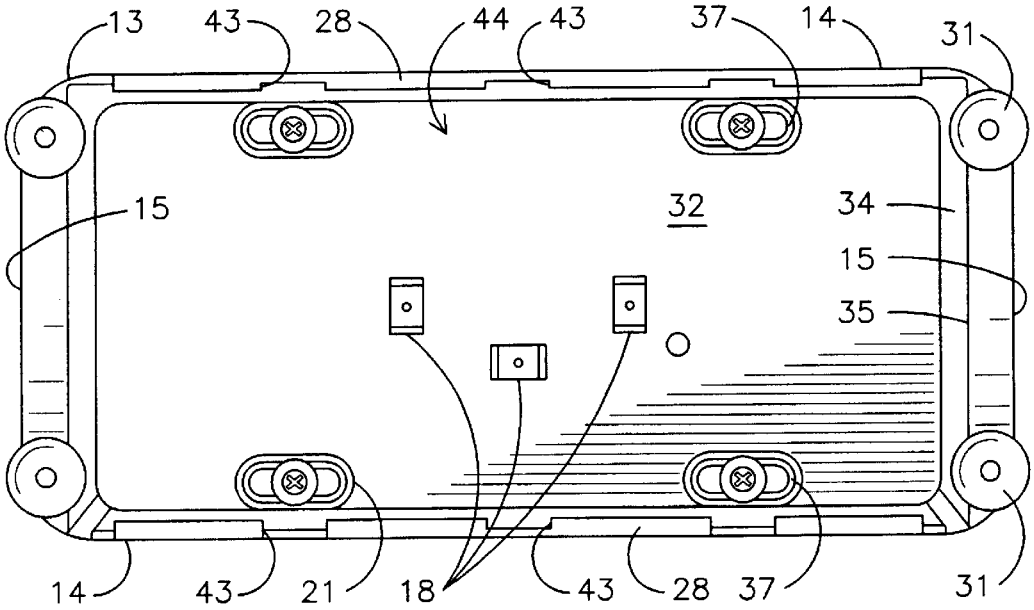
FIG. 6 is a top view of the support frame.
Figure 7:
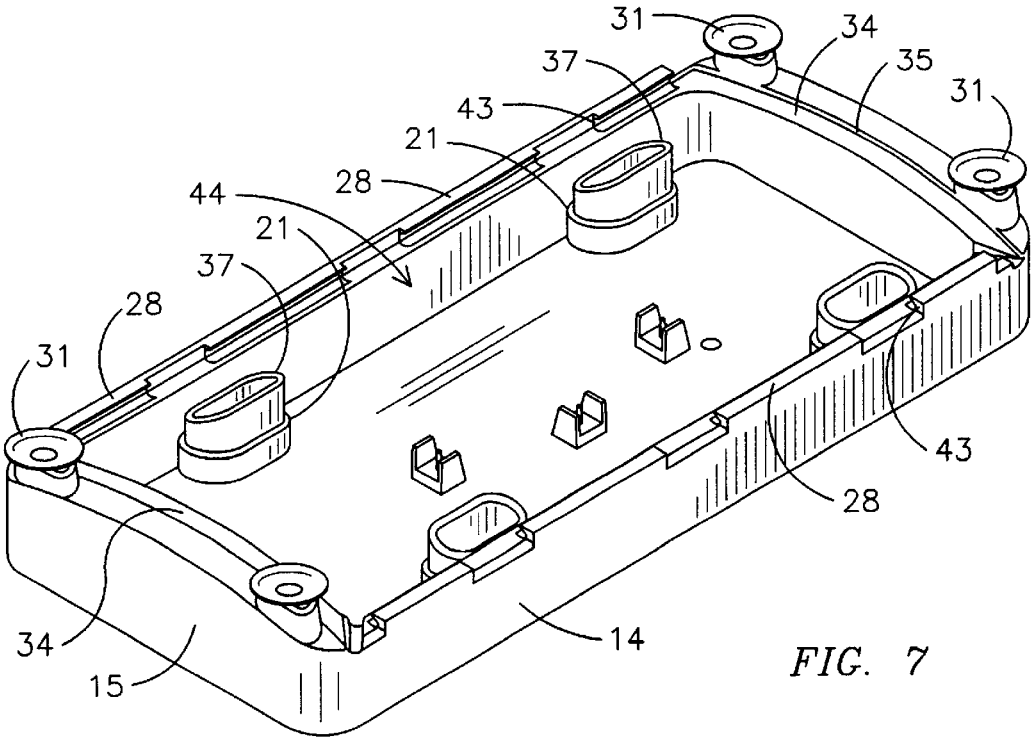
FIG. 7 is a perspective view of the support frame.
Figure 8:
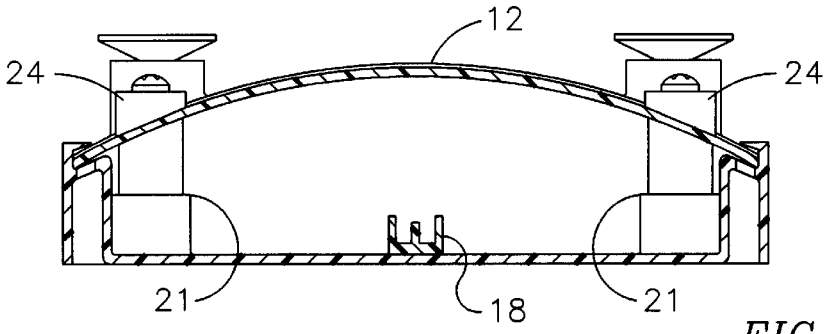
FIG. 8 is a sectional view taken along line 8—8 in FIG. 2.
Figure 10:
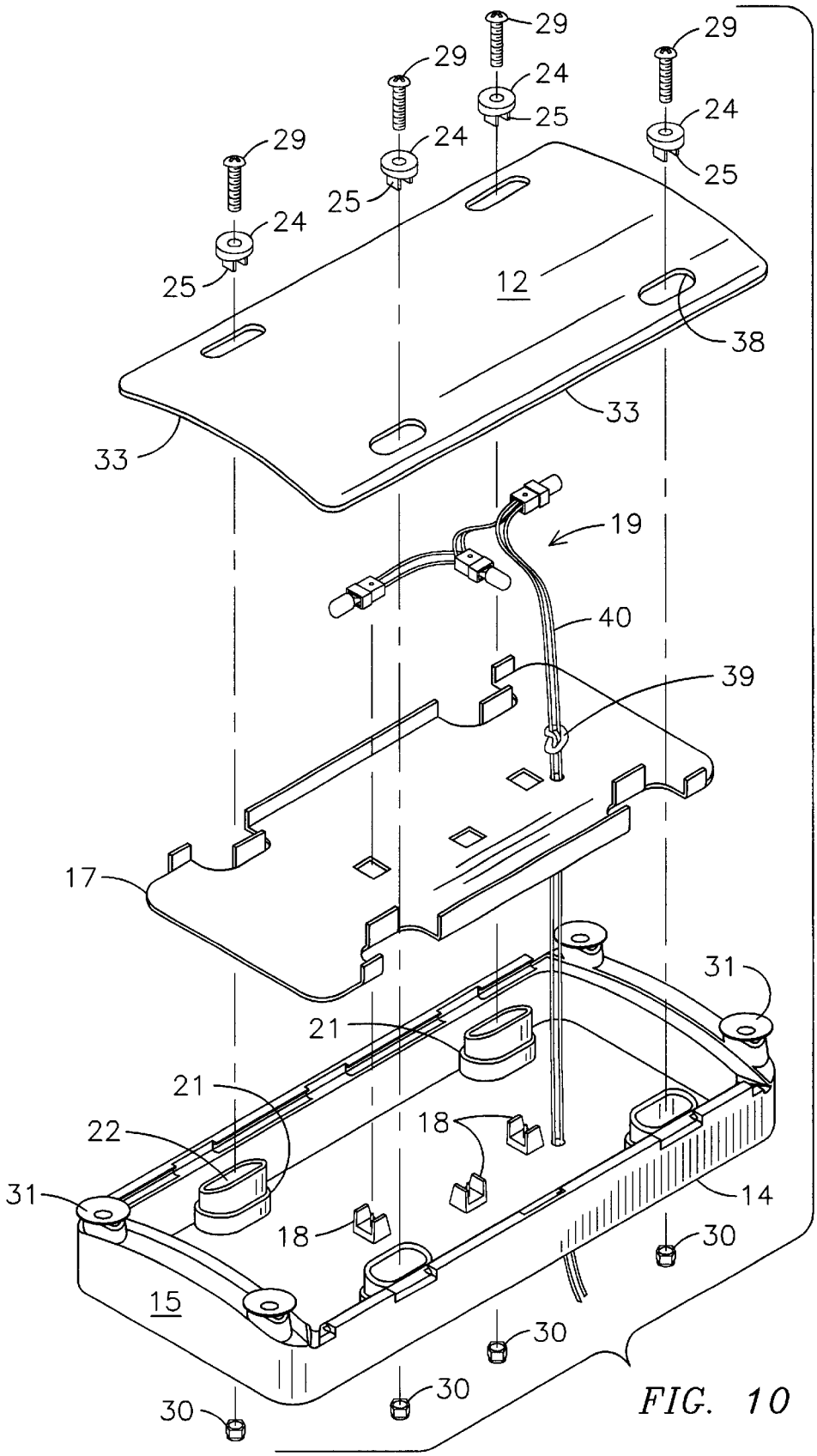
FIG. 10 is an exploded perspective view of the illuminated display assembly.
Figure 12:
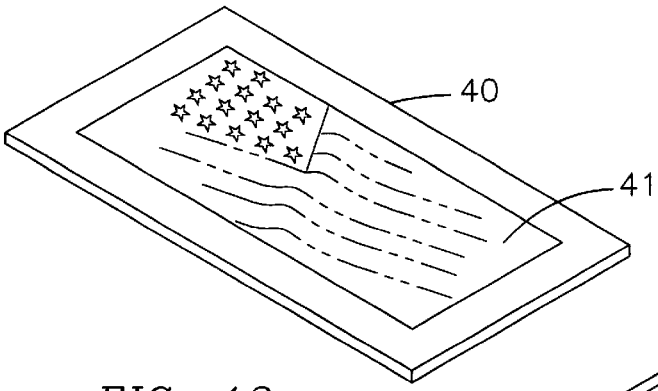
FIG. 12 is a perspective view of an individual substrate cut from the substrate sheet then trimmed.
Figure 13:
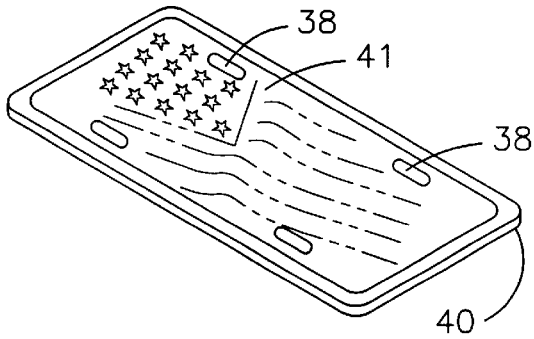
FIG. 13 is a perspective view of the substrate having been trimmed.
Figure 14:
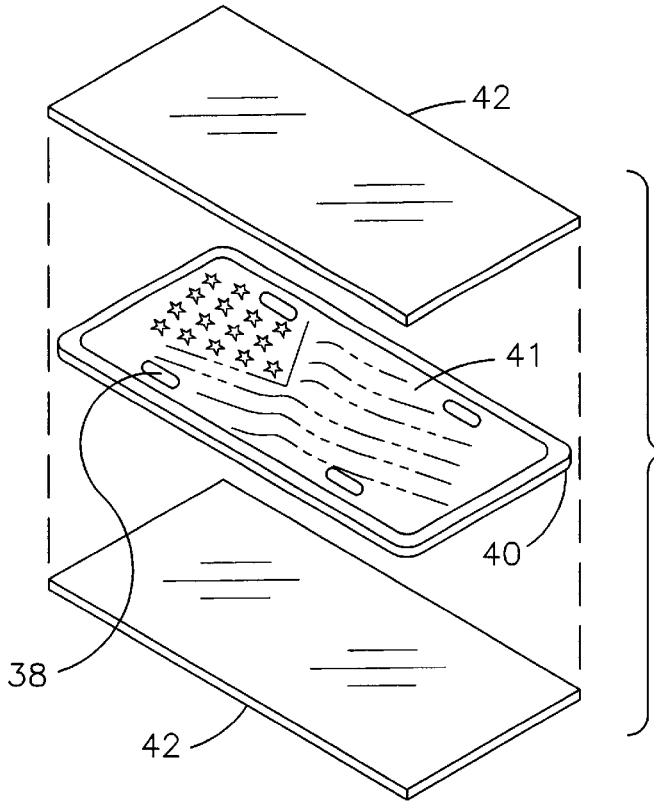
FIG. 14 is a perspective view of the encapsulation of a substrate with an image.
Figure 15:
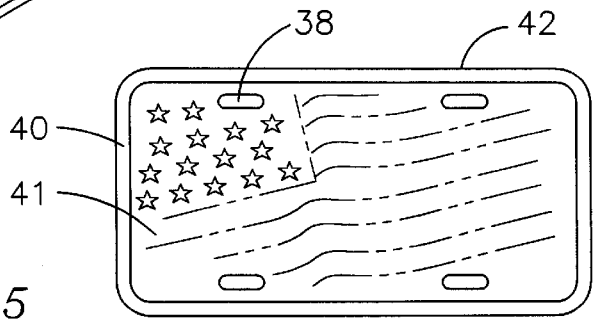
FIG. 15 is front view of the display plate having been trimmed.

As shown in FIGS. 6 and 7, the support frame 11 has a support member 13 extending along the periphery of a panel 32. The support member 13 extends outward from the panel 32 substantially perpendicular to the panel 32 forming an interior of the support frame 11. The support member 13 has two side supports 14 and two end supports 15. As shown in FIGS. 1 and 10, the display plate 12 is rectangular and has edges 33 that extend along the top surface of the side supports 14 and end supports 15 of the support frame 11 when mounted on the support frame 11.

A retainer 28 extends along a top edge of the side supports 14 forming an elongated channel within which edges 33 of the display plate 12 fit to secure the display plate 12 on the support frame 11. A dimension across the support frame 11 measured from the retainers 28 is less than the width of the display plate 12 measured from the edges 33 of the display plate 12. Thus, when edges 33 of the display plate 12 are inserted into the retainer 28, the plate 12 bulges outward with respect to an interior of the support frame 12. In addition, notches 43, formed in the retainer 28, are spaced apart along the retainer 28. A user is able to engage the exposed edges 33 of the display plate 12 extending within the notches 42 to remove the display plate 12 from the support frame 11.

Figure 5:
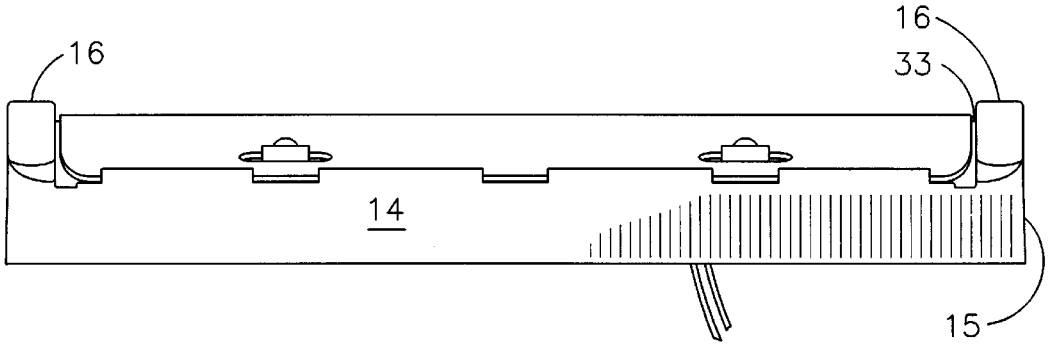
FIG. 5 is a second side elevational view of the illuminated display assembly.

With respect to FIGS. 5 and 7, the end supports 15 of the wall 13 on the support frame 11 have a convex top surface that extends subjacent and concentrically with respect to the edges 33 of the display plate 12 and peripheral portion of the plate 12. As shown FIG. 7, an elongated recess 34 extends along the top surface of each end support 15 forming a rim 35. When the display plate 12 is secured on the support frame 11, the edges 33 of the plate 12 seat along the recess 34, and a top surface of the plate 12 is substantially flush with the rim 35 of the end support 15. In this manner, the end support 15 seal the interior of the display box 11 to prevent light from escaping from the support frame 11.

Referring again to FIGS. 6 through 9, the interior of the support frame 11 is shown. A plurality of spacers 21 is fixed to the panel 32. The spacers 21 extend above the side supports 14 and each has an inclined top surface 37 that extends substantially parallel or concentric subjacent to the plate 12. The spacers 21 have apertures 22 that receive a bolt 29 to secure the plate 12 on the support frame 11. Apertures 38 are also formed on the plate 12 and are aligned with the apertures 22 on spacers 21. A washer 24, nut 30 and bolt 29 are used to secure the plate 12 on the support frame 11.

Figure 9:
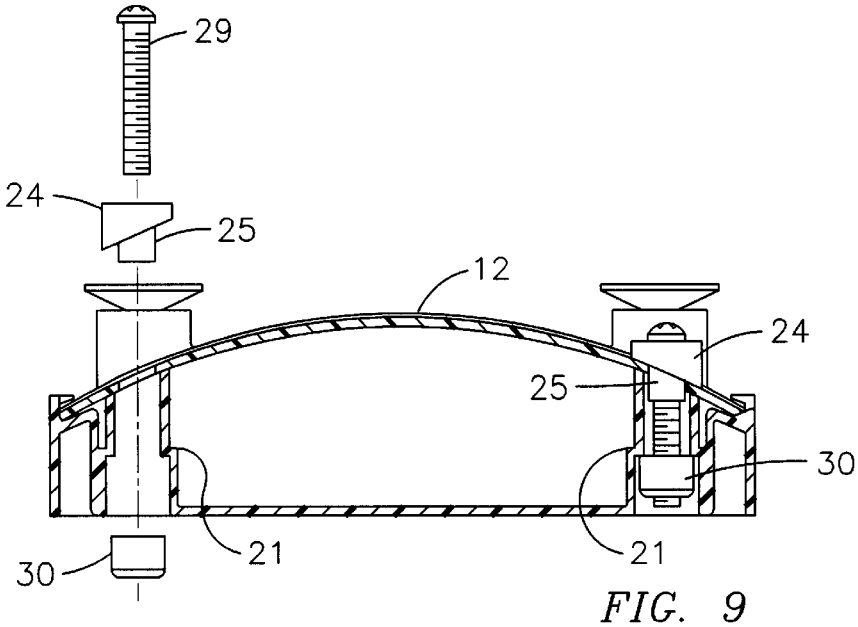
FIG. 9 is a sectional view taken along line 9—9 in FIG. 2.

The washer 24 is illustrated in more detail in FIG. 9. The washer 24 has an inclined bottom surface 26 that extends substantially parallel or concentrically to the display plate 12 and top surface 37 of the spacer 21. In addition, two prongs 25 depend from the washer 24. When the washer 24 is placed over the plate 12 the prongs 25 are inserted in the apertures 38 on the plate 12 and apertures 22 on the spacers 21, locking the washer 24 in place. The bolt 29 is inserted through the washer 24, plate aperture 38, and spacer aperture 22, and the nut 30 is threaded on the bolt 29.

With respective to FIG. 10, a reflective surface 17 is disposed along the panel 32 to disperse within the support frame 11 the display plate 12. The reflective surface 17 can comprise any material that adequately reflects such as a metal foil sheet. In a preferred embodiment, the reflective surface is constructed from a heavy paper material such as cardboard that has been treated with a material such as wax to create a shiny surface that reflects light. In addition, the cardboard is white, as opposed to being colored, to enhance light reflection. The reflective surface 17 is perforated at predetermined locations, or holes are formed therein, to conform to the interior shape of the support frame 11, and other elements within the interior of the support frame 11.

The illumination device 19 is shown in FIG. 10. The illumination device 19 includes three lighting elements that are typically used in trailer lights. The illumination device 19 is secured within the support frame 11, by clamps 18. The wiring 40 for the illumination device 19 extends through a hole 20 in the panel 32, and is linked to the vehicle electrical system or otherwise connected to an energy source. A stop 39 can be fixed to the wiring 40 within the support frame 11 to prevent wires 40 from being pulled, dislodging the illumination device 19. As shown in FIG. 10, the wiring 40 is tied in a knot to form the stop 39.

An exploded view of the illuminated display assembly 10 is shown in FIG. 10. The reflective surface 17 is first installed within the support frame 11. Then the illumination device 19 is fixed on the clamps 18. The display plate 12 is placed on the support frame 11 by inserting the edges 33 of the display plate 12 within the retainer 28 on the side supports 15. The washers 24 are then placed over the display plate 12, inserting the prongs 25 through apertures 38 and 22. The bolts 29 are then inserted through the washers 24, plate 12 and spacers 21, and threaded on respective nuts 30.

With respect to FIGS. 11 through 15, the fabrication of the plate 12 is shown. The plate 12 consists of translucent substrate 40 having an image 41 formed thereon. The substrate 40 is encapsulated within a transparent flexible casing 42. The substrate 40 is preferably composed of a synthetic banner material. Kimberly Clark sells an acceptable banner material under the trade name KIMDURA.

Figure 11:
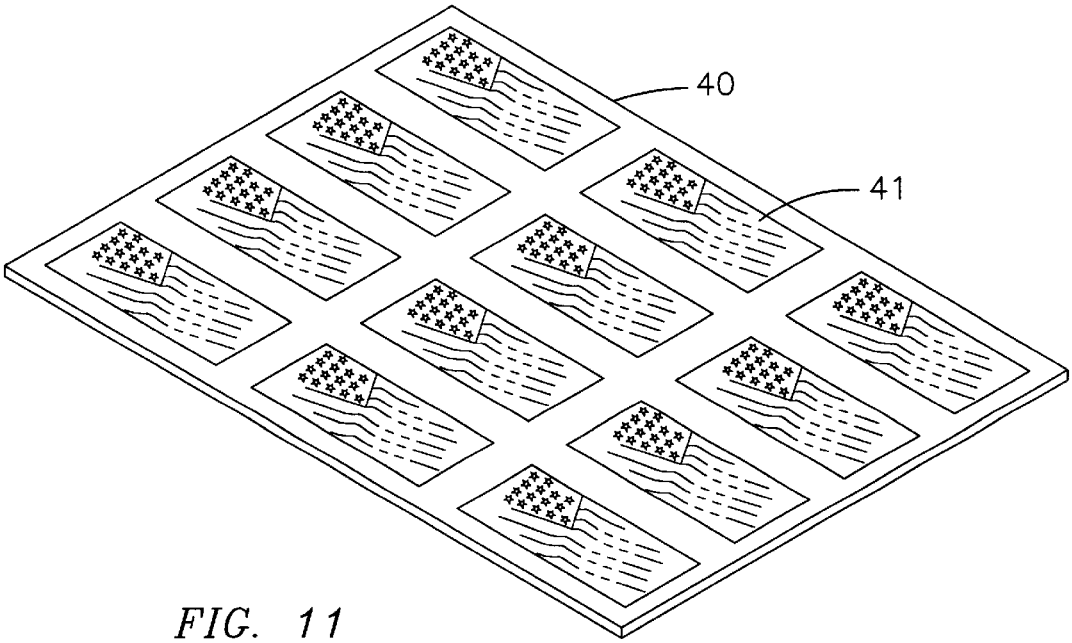
FIG. 11 is a perspective view of a substrate sheet material having images printed thereon.

An image is selected and reproduced on a sheet of the substrate 40 as shown in FIG. 11. A digital image is generated and reproduced using a digital printing machine. One such machine available for producing a plurality of digitally generated images on a substrate is the HP 5000 digital printer manufactured by Hewlett-Packard. Inks, resistant to ultraviolet radiation, are preferably used to avoid the image 41 from fading when exposed to light. The printer then reproduces an array of images on a sheet of the substrate material 40. The printer can be programmed to reproduce more than a single image design within the array.

The shape of the plate 12 is selected and the substrate 40 is then cut using a die cut procedure to create a plurality of individual substrates 40 having a selected image 41. Apertures are cut into the substrates during the die cut procedures. The individual substrates 40 with images 41 are then encapsulated within a transparent plastic casing 42 using conventional laminating techniques. The plastic is transparent and durable enough to withstand exposure to the environment. For example, a 15 mill thick plastic is an acceptable sheet thickness for the present invention. A periphery of the casing 42 is trimmed using a die cut procedure so the shape of the casing 42 corresponds to the shape of the substrate 41. In addition, apertures 38, aligned with apertures on the substrate, are cut into the casing 42 during the die cut procedure. The plate 12 having been completed can be mounted on the display box 11 as previously described.

While the preferred embodiments of the present invention have been shown and described herein in this context, it will be obvious that such embodiments are provided by way of example only and not of limitation. Numerous variations, changes and substitutions will occur to those of skilled in the art without departing from the invention herein. For example, the present invention need not be limited to the rectangular support frame fabricated from an injection molding process, since other applications can equally benefit from the teachings of the present invention. The support frame may be constructed of other materials and plurality of parts coupled together. Accordingly, it is intended that the invention be limited only by the spirit and scope of the appended claims.

What I claim as my invention is:

1. An illuminated display assembly, comprising:

a. a flexible translucent display plate having an outer edge defining a periphery of the plate and an image depicted on the display plate within said periphery;

b. a support frame having a panel and a support member extending along a periphery of the panel, and said support member extending outward from the panel forming an opening;

c. a retainer disposed along the support member, in spaced relation to the panel, receiving the edge of the display plate, convexly deforming said display plate with respect to the support frame and the display plate covering the opening;

d. said support member having two end supports with each end support having a convex top surface extending subjacent with respect to the periphery of the display plate;

e. an illuminating device fixed to the support frame between the panel and the display plate and emitting light through the opening and display plate; and f. means, coupled to the support frame, for mounting the display plate to the support frame, wherein said mounting means includes a plurality of bolts and said display plate having a plurality of apertures and said support frame having a plurality of apertures, and each aperture on the display plate is aligned with an aperture on the support frame and said bolts extend through the apertures on the display plate and the support frame, for mounting the display plate to the support frame.

2. The assembly of claim 1 further including a reflective surface mounted to the support frame between the panel and the display plate, and said illuminating device is secured to the panel between the reflective surface and the illuminating device.

3. The assembly of claim 1 wherein said display plate includes a translucent substrate having an image depicted thereon and said substrate is encapsulated within two transparent plastic films laminated together.

4. An illuminated display assembly, comprising:

a. a flexible translucent display plate having an outer edge defining a periphery of the plate and an image depicted on the display plate within said periphery;

b. a support frame having a panel and a support member extending along a periphery of the panel, and said support member extending outward from the panel forming an opening;

c. a retainer disposed along the support member, in spaced relation to the panel, receiving the edge of the display plate, convexly deforming said display plate with respect to the support frame and the display plate covering the opening;

d. said support member having two end walls with each having a convex top surface extending subjacent with respect to the periphery of the display plate;

e. an illuminating device fixed to the support frame between the panel and the display plate and emitting light through the opening and display plate; and f. said support frame includes a plurality of spacers attached to the panel within the periphery of the panel and extending therefrom, each said spacer having a top surface extending subjacent and concentric to a bottom surface of the display plate, and each said spacer having an aperture, and said display plate having a plurality of apertures and each aperture on the display plate is aligned with an aperture on a spacer, and said assembly further including a plurality of fasteners operatively connected to the spacers and the plate through the apertures, and securing the display plate on the support frame.

5. An illuminated display assembly, comprising:

a. a flexible, translucent and rectangular display plate having an outer edge including two opposing side edges and two opposing end edges, and an image depicted on the display plate within said outer edge of the plate and said plate having a width dimension measured from the opposing side edges;

b. a support frame having a rectangular panel and a support member extending along a periphery of the panel, and said support member extending outward from the panel;

c. said support member including two opposing side supports and two opposing end supports forming a rectangular opening;

d. a first retainer disposed along one of the side supports and a second retainer disposed along the opposing side support, and said support frame having a dimension measured from the first retainer to the second retainer that is less than the width of the display plate;

e. said first retainer and second retainer receiving respective side edges of the plate, and said display plate deforming in a convex shape with respect to the support frame;

f. said opposing end supports each having a convex top surface extending subjacent with respect to the end edges of the display plate;

g. an illuminating device fixed to the support frame, and emitting light through the opening and the display plate; and, h. a display plate mounting means includes a plurality of bolts and said display plate having a plurality of apertures and said support frame having a plurality of apertures, and each aperture on the display plate is aligned with an aperture on the support frame and said bolts extend through the apertures on the display plate and the support frame, for mounting the display plate to the support frame.

6. The assembly of claim 5 wherein said display plate includes a translucent substrate having an image depicted thereon and said substrate is encapsulated within two transparent plastic films laminated together.

7. The assembly of claim 5 wherein each of the first retainer and the second retainer has a plurality of voids spaced apart along said retainers, exposing portions of the outer edge of the display plate allowing for the removal of the display plate from the support frame.

8. The assembly of claim 5 further including a reflective surface mounted to the support frame between the panel and the display plate.

9. An illuminated display assembly, comprising:

a. a flexible, translucent and rectangular display plate having an outer edge including two opposing side edges and two opposing end edges, and an image depicted on the display plate within said outer edge of the plate and said plate having a width dimension measured from the opposing side edges;

b. a support frame having a rectangular panel and a support member extending along a periphery of the panel, and said support member extending outward from the panel;

c. said support member including two opposing side supports and two opposing end supports forming a rectangular opening;

d. a first retainer disposed along one of the side supports and a second retainer disposed along the opposing side support, and said support frame having a dimension measured from the first retainer td the second retainer that is less than the width of the display plate;

e. said first retainer and second retainer receiving respective side edges of the plate, and said display plate deforming in a convex shape with respect to the support frame;

f. said opposing end supports each having a convex top surface extending subjacent with respect to the end edges of the display plate;

g. an illuminating device fixed to the support frame, and emitting light through the opening and the display plate; and, h. the support frame includes a plurality of spacers attached to the panel within the periphery of the panel and extending therefrom, each said spacer having a top surface extending subjacent and concentric to a bottom surface of the display plate, and each said spacer having an aperture, and said display plate having a plurality of apertures and each aperture on the display plate is aligned with an aperture on a spacer, and said assembly further including a plurality of washers wherein each washer has a surface abutting a top surface of the display plate and extending concentrically with respect to the top surface of the display plate, and each washer having an aperture, and a bolt extending through the apertures in the washer, display plate and spacer, and said bolt secured to the frame by a nut.

10. An illuminated display assembly, comprising:

a. a flexible, translucent and rectangular display plate having an outer edge including two opposing side edges and two opposing end edges, and an image depicted on the display plate within said outer edge of the plate and said plate having a width dimension measured from the opposing side edges;

b. a support frame having a rectangular panel and a support member extending along a periphery of the panel, and said support member extending outward from the panel;

c. said support member including two opposing side supports and two opposing end supports forming a rectangular opening;

d. a first retainer disposed along one of the side supports and a second retainer disposed along the opposing side support, and said support frame having a dimension measured from the first retainer to the second retainer that is less than the width of the display plate;

e. said first retainer and second retainer receiving respective side edges of the plate, and said display plate deforming in a convex shape with respect to the support frame;

f. said opposing end supports each having a convex top surface extending subjacent with respect to the end edges of the display plate;

g. an illuminating device fixed to the support frame, and emitting light through the opening and the display plate; and, h. said convex top surface of each end support has an elongated indentation forming a rim on the convex top surface of each end support and the display plate seats within the rim.

* * * * *